US005761997A

United States Patent [19]

Xydias

[11] Patent Number: 5,761,997

[45] Date of Patent: Jun. 9, 1998

[54] APPARATUS FOR ALIGNING SURFACES

[75] Inventor: Jean Xydias, Pittsford, N.Y.

[73] Assignee: Eastman Kodak Company, Rochester, N.Y.

[21] Appl. No.: 595,708

[22] Filed: Feb. 2, 1996

[51] Int. Cl.[6] ..... B41F 9/10

[52] U.S. Cl. ..... 101/169

[58] Field of Search ..... 101/157, 169, 101/365, 366, 350.1, 350.6, 363; 118/261

[56] References Cited

U.S. PATENT DOCUMENTS

| | | | |
|---|---|---|---|
| 2,068,839 | 1/1937 | Behringer . | |
| 2,148,455 | 2/1939 | Golber et al. . | |
| 2,151,968 | 3/1939 | Henderson . | |
| 2,187,421 | 1/1940 | George . | |
| 2,387,332 | 10/1945 | Kunz | 101/365 |
| 2,523,643 | 9/1950 | Bennison . | |
| 2,688,919 | 9/1954 | Kaiser . | |
| 3,186,339 | 6/1965 | Turner et al. | 101/169 X |
| 3,783,781 | 1/1974 | Grommek . | |
| 3,981,238 | 9/1976 | Dini . | |
| 4,393,776 | 7/1983 | Toyoda | 101/365 |

*Primary Examiner*—J. Reed Fisher
*Attorney, Agent, or Firm*—Clyde E. Bailey, Sr.

[57] ABSTRACT

Apparatus (10) for adjusting and aligning a first, slidable surface (12) in proximate contact with a second, rotating surface (14). Means for urging a lateral edge of the first surface (12) towards and subsequently in contact with the second surface (14) includes a motion transfer system which includes a pivot arm (18,19) driven by a respective rotatable rod-like member (40,42). The rod-like member (40,42), when moved axially, urges the respective pivot arm (18,19) into forced moving contact with an end portion of the first surface (12) until it is aligned with and subsequently in proximate contact with the roller surface (14). Alignment of the doctor blade (12) is achieved by turning a hex nut portion of the rod like member controlling the respective pivot arm until the end portion of the blade is aligned identically with the roller surface (14).

5 Claims, 5 Drawing Sheets

APPARATUS FOR ALIGNING SURFACES

TECHNICAL FIELD

The present invention relates generally to aligning surfaces. More particularly, the invention is concerned with an apparatus, in a gravure printing machine, for aligning a first surface, for instance a doctor blade, with a second, moving surface so that the first surface (blade) can uniformly and efficiently remove residual material, for instance ink, from the moving surface.

BACKGROUND OF THE INVENTION

In a typical gravure printing machine, a printing material, such as ink, is supplied to a roller which then transfers the ink to a product surface. During this process, residual ink is routinely removed from the roller so as to avoid blotching and unwanted spotting of the ink onto the product surface. Conventional gravure printing machines use a doctor blade for wiping the roller of residual printing material. Prior art doctor blades in gravure printing environments are configured so that the entire width of the lateral edge of the blade will uniformly contact the surface of the ink transfer roller for removing a residual layer of ink therefrom.

One problem with the present practice is that when the lateral edge of the blade is out of alignment with the roller surface, as evidenced for instance by blotching on the product, it is often difficult and time consuming to align the blade so that the entire width of the lateral edge will once again uniformly contact the ink transfer roller. This is because the process for urging an end portion of the doctor blade towards the roller surface so that the entire width of the lateral edge of the blade uniformly contacts the roller surface first involves at least partially releasing the securing means holding the blade securely against the roller. Next, the misaligned end portion of the blade must be realigned so that the entire width of the lateral edge aligns with and uniformly contacts the roller surface. Once aligned, the blade must be secured so that the realigned blade remains in uniform contact with the roller surface during printing operations. .

In U.S. Pat. No. 3,783,781, a typical prior art doctor blade alignment mechanism is shown (FIG. 1) which includes a pair of threaded screws (3) positioned at either end of the blade 1 which can selectively drive an end portion of the doctor blade (1) towards the roller surface (2) in alignment with the remaining end portion. These screws (3) are mounted so that they are in contact with the back side of the blade shuttle or frame which supports the blade (1) against the printing machine. Moreover, hexed head (4) of the screws (3) are accessible for turning thereby causing the displacement of the end portion of the blade towards and ultimately in contact with the roller surface.

Thus, if adjusting the doctor blade is indicated, the securing means must be manipulated so as to at least partially release the doctor blade and then one of the adjustable screws must be turned to displace the end of the blade against the roller surface. During this process, the gravure printing machine has to be slowed down or stopped to accommodate the adjustment. In both these instances, product cycle time and machine uptime are both adversely affected. Moreover, the prior art blade adjustment process presents safety problems to the operator because the operator has to reach among the exposed moving machine parts to effectuate the blade adjustment. While conventional blade adjustment practices have proven adequate for slower speed operations, future high production speed demands driven by reduced cycle time requirements will require substantially more reliable, safe and precise means for aligning the doctor blade with the roller surface.

Therefore, a need persists for an apparatus that can reliably, easily, safely and uniformly align a doctor blade in proximate contact with a moving surface operating at high production speeds so that residual printing material, such as ink, may be evenly removed from the moving surface without extended interruption to the printing operation do to required downtime to make a blade adjustment.

SUMMARY OF THE INVENTION

It is, therefore, an object of the invention to provide an apparatus for aligning a lateral edge of a first surface with a second surface.

Another object of the invention is to provide an apparatus that can reliably adjust a misaligned doctor blade without exposing the operator to the risk of injury while performing the adjustment.

It is an advantage of the invention that a misaligned doctor blade can be easily, reliably and safely aligned with a rotating print roller surface without extended interruptions to the printing operation.

It is a feature of the invention that a means for urging the doctor blade into alignment with the rotating roller surface is responsive to remotely accessible motion transfer systems configured to independently urge an end portion of the doctor blade into alignment and subsequent proximate contact with the moving surface while the opposing end portion remains fixed.

To achieve these and other objects of the invention, there is provided, in one aspect of the invention, an apparatus for aligning a first, slidable surface in proximate contact with a second, rotating surface. The apparatus generally comprises a frame for supporting the first surface for translational movement. Means communicating with said frame is provided for urging a lateral edge of the first surface towards and in proximate contact with the second surface. Further, means cooperating with the urging means is provided for activating the urging means to slidably move the first surface into proximate contact with the second surface.

In another aspect of the invention, a method of uniformly aligning a first surface with a second, rotating surface is provided. In this embodiment of the invention, an urging member arranged for continuous contact with the first surface is provided. The first surface is capable of translational movement toward a rotating surface in response to means for activating the urging member. When activated, the urging member transfers movement to the first surface thereby moving the first surface until the first surface is uniformly aligned and in proximate contact with the second surface.

BRIEF DESCRIPTION OF THE DRAWINGS

The foregoing and other objects, features and advantages of the invention will become more apparent form the following drawings.

DESCRIPTION OF THE PREFERRED EMBODIMENT

Figure 1:
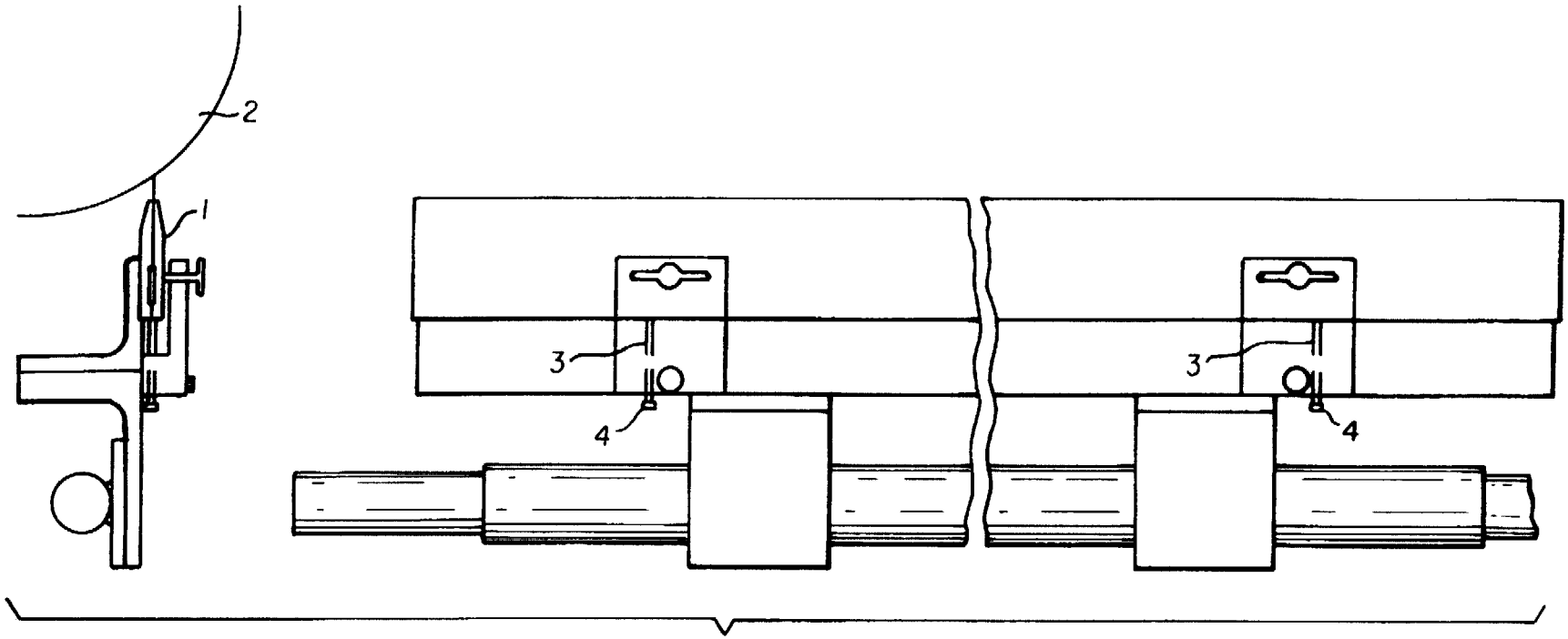
FIG. 1 (prior art)
FIG. 1 is a top plan view of a prior art doctor blade trimming mechanism.
Figure 2:
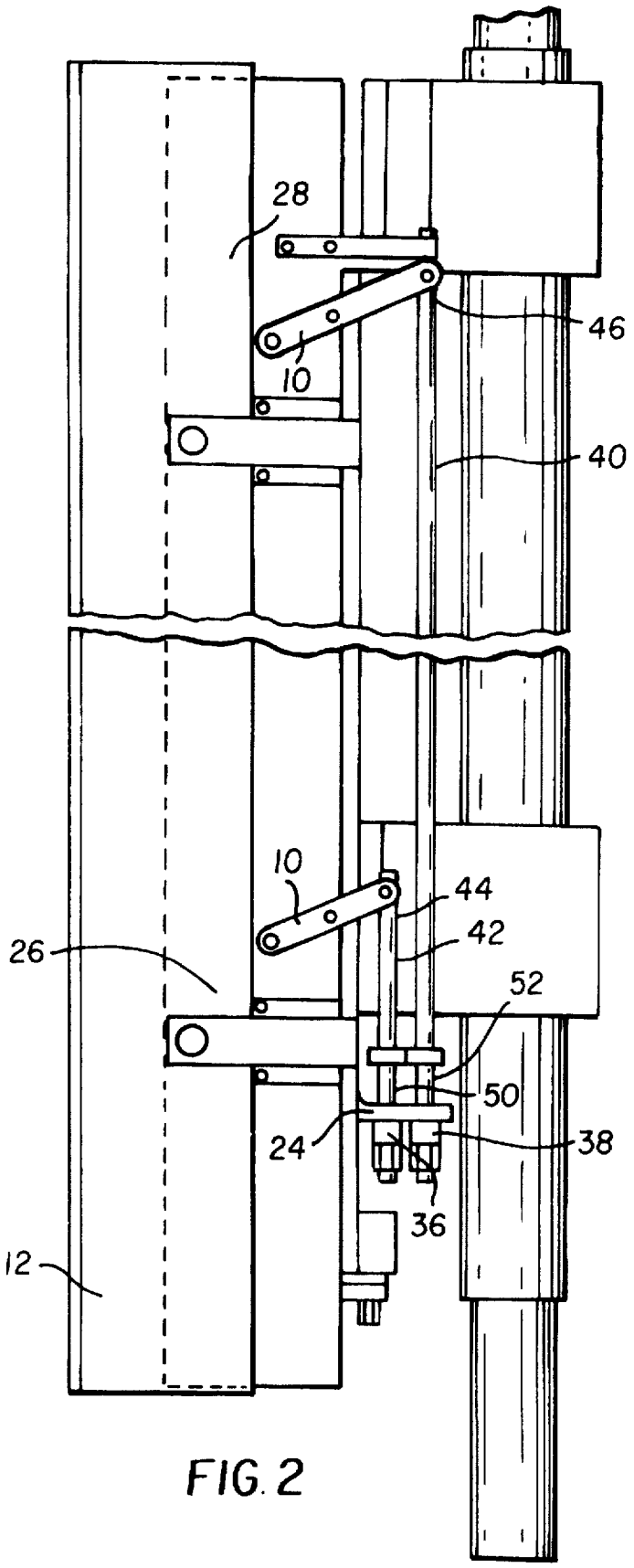
FIG. 2 is a top plan view of the apparatus of the invention.
Figure 3:
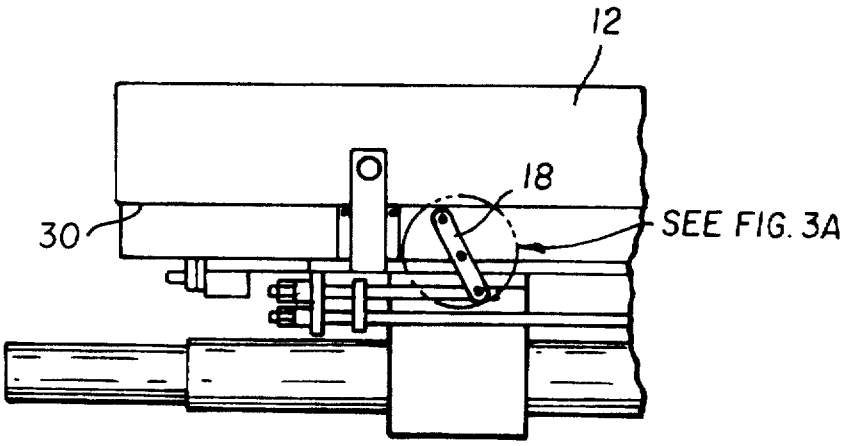
FIG. 3 is an enlarged top view of the urging device of the invention.
Figure 3A:
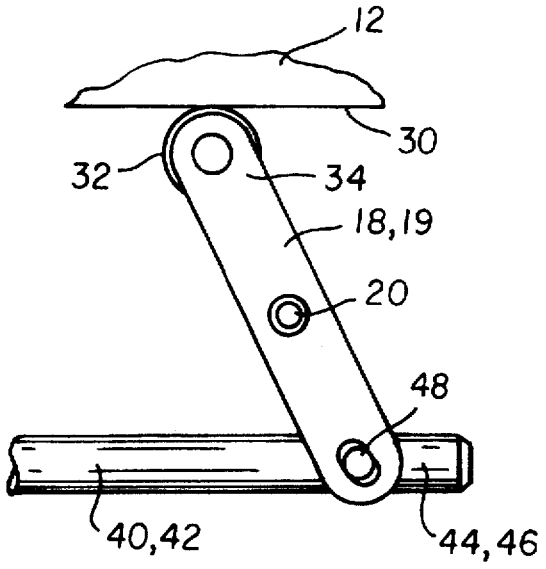
Figure 5:
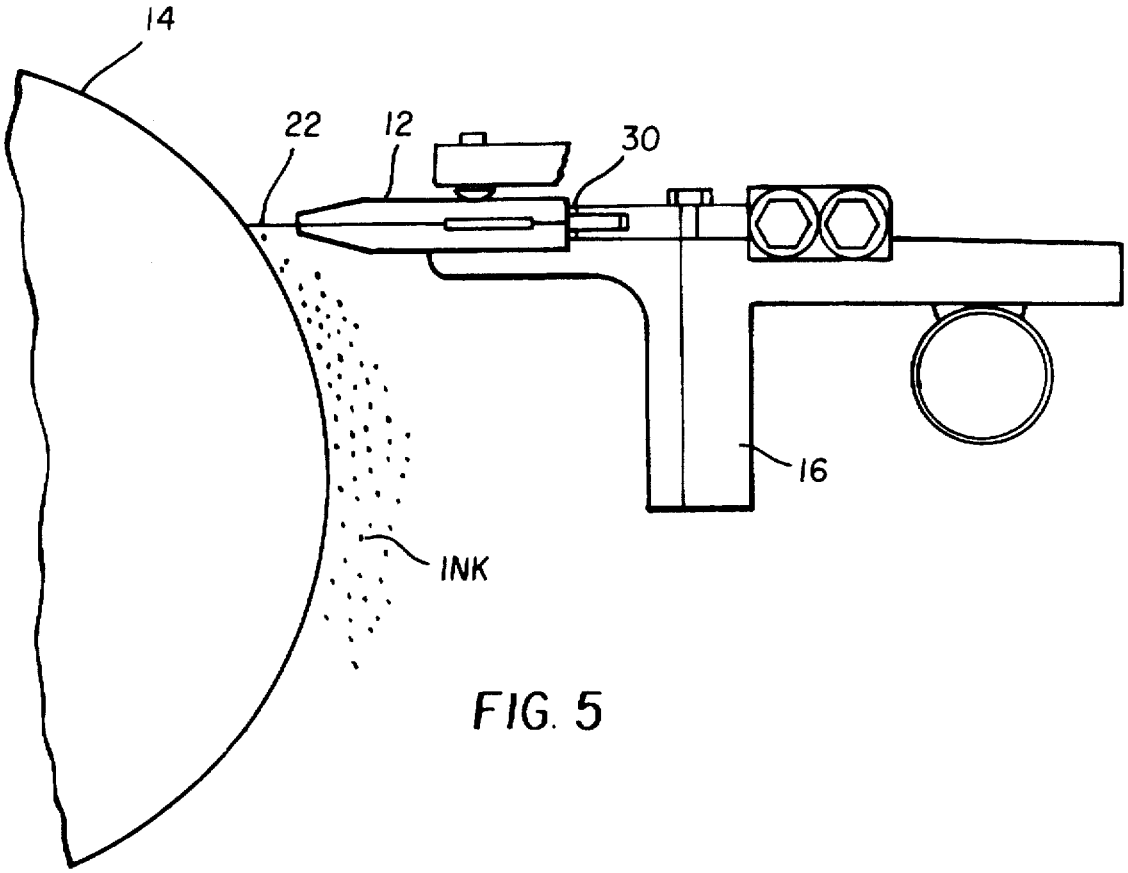
FIG. 5 is a side elevational view of the invention with the elements exposing the urging element of the invention.

Turning now to the drawings, and more particularly to FIGS. 2, 3 and 5, the apparatus 10 in accordance with the principles of the invention is illustrated. Apparatus 10 for adjusting a first, slidable surface, or doctor blade, 12, into proximate contact with a second, rotating surface, or print roller 14, includes a frame 16 for supporting the first surface 12 for translational movement. Proximate contact is achieved when the first and second surfaces 12,14 substantially touch thereby enabling excess material on the second surface to be relieved therefrom without affecting the speed of the rotating second surface 14. A means, or pivot arm 18, structurally connected to the frame 16 by a pivot pin 20 or other suitable means, such as a screw, is provided for urging a lateral edge 22 of the first surface 12 towards the second surface 14. Further, in this embodiment of the invention, means, or motion transfer system (described in details below), such as a nut plate, 24, fixed to the supporting frame 16 is provided for activating the pivot arm 18 to urge the first surface 12 towards the second surface 14.

FIGS. 2 & 3 illustrate apparatus 10 having pivot arms 18,19 arranged along and in continuous contact with opposing end portions 26,28, respectively, of the rear side 30 of the first surface or blade 12. This arrangement enables pivot arms 18,19 to smoothly impart movement to a respective end portion 26,28 of the blade 12 when blade alignment is indicated. Skilled artisans will appreciate that other means within the scope of the invention of imparting movement to the blade 12 for alignment with rotating second surface 14 may also be used such as a biased or reciprocating plate (not shown) for urging the blade 12 into alignment with the second surface 14. According to FIG. 3, pivot arm 18,19 each pivots about frame 16 via a pivot pin 20 joining the pivot arm to the frame 16. Each pivot arm 18,19 has a contact surface, preferably a steel roller, 32 extending from the end edge 34 of the pivot arm 18,19. The contact surface 32 enables substantially frictionless translational motion between the pivot arm 18,19 and the rear side 30 of first surface or blade 12.

Figure 4:
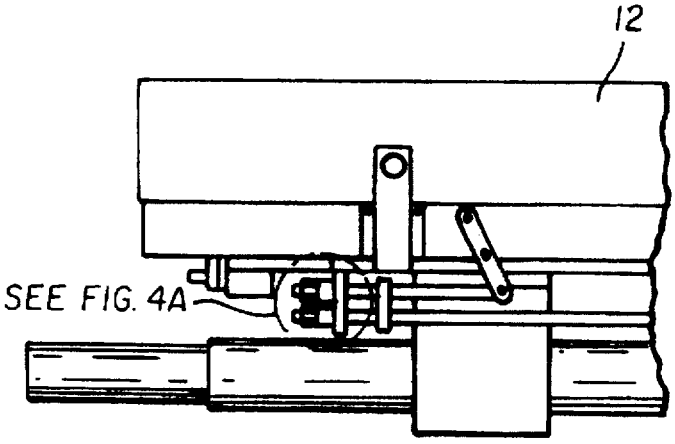
FIG. 4 is a top view of the motion transfer device of the invention.
Figure 4A:
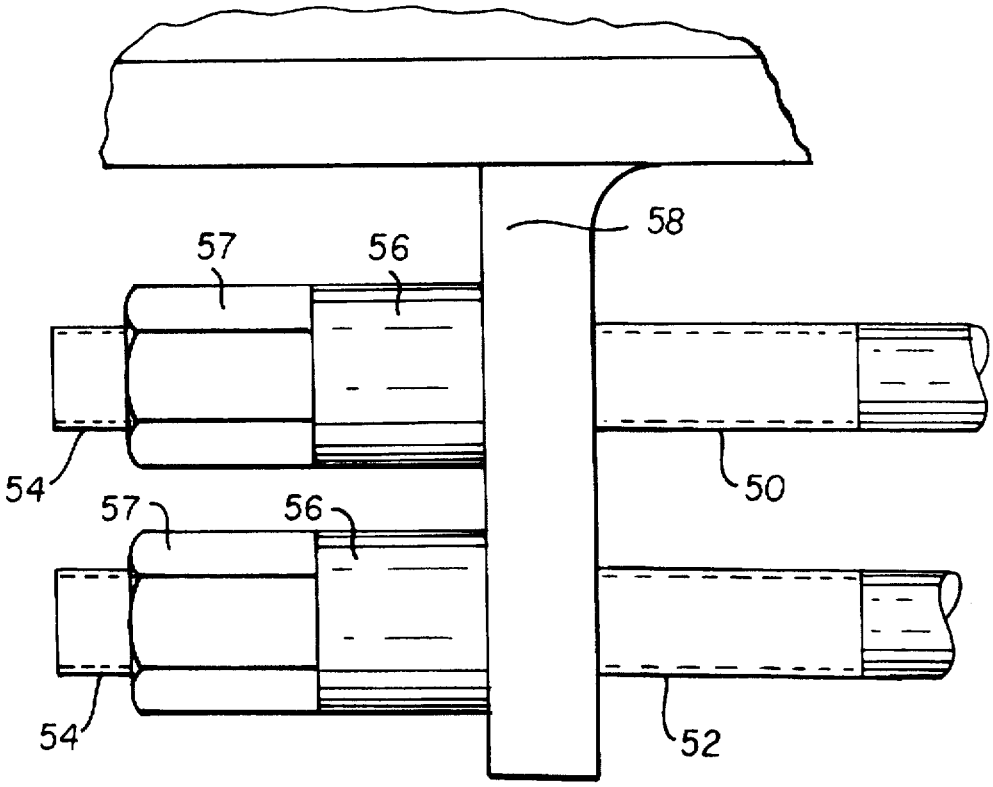

As shown clearly in FIG. 2, pivot arms 18,19 are driven by independent motion transfer assemblies 36,38 each having a shaft or rod-like member 40,42 linked, respectively, at one end 44,46 to a respective pivot arm 18,19. A connecting pin 48 is preferably used to link the pivot arm 18,19 to the rod 40,42. At the opposite ends 50,52 of the respective rod-like members 40,42 a threaded portion 54 provided for connecting a nut element 56, preferably having a hexed portion 57 (FIG. 4) for receiving a rotating tool (not shown), is rotatably mounted in a pair of retaining plate members 58 secured with screws to frame 16. Retaining plate members 58 have a bore opening for receiving the nut element 56 and for allowing nut element 56 to rotate radially therein about the members 40,42 but not to move axially along the rod-like members 40,42.

In another aspect of the invention, a method for urging a first surface 12 into alignment and subsequently in proximate contact with a second surface 14 comprises the step of providing an urging member, preferably pivot arm, 18 (as described above) in continuous contact with the first surface 12. In this embodiment, the first surface 12 is capable of translational movement toward the second, rotating surface. When aligning is necessary, typically only one end portion of the blade 12 is urged into alignment with the roller surface 14 while the other end portion remains fixed or secured against movement. Thus, the stationary end portion acts as a pivot point about which the alignable end portion is allowed to move in response to the action of the pivot arm 18. Moreover, in this embodiment, means (as described above) is provided for activating the urging member or pivot arm 18. When activated, the urging member or pivot arm 18 transfers movement to the first surface 12 and moves the designated end portion of the first surface 12 until it is in proximate contact with the second, or roller surface 14.

A pair of rod-like members 40, 42 pivotably connected to a respective urging member controls the movement of a respective end of the first surface. According to FIG. 2, rod-like member 42 is arranged in frame 16 so as to move one end portion of first surface 12 while rod-like member 40 is arranged to move an opposite end portion of the first surface 12. As described, the rod-like member 40,42 when moved axially in a first direction moves the urging member or pivot arm 18,19 info driving contact with the first surface 12 thereby causing the first surface 12 in response thereto to move toward and subsequently in proximate contact with the second surface or roller 14.

In operations, to adjust or trim the doctor blade 12 so as to realign the lateral edge 22 with the second surface or roller surface, 14, first the end portion 26,28 of the doctor blade 12 requiring aligning or trimming must be identified. This is typically done by visual inspection or by an indication of degradation of product quality. Once the need for alignment is determined, the motion transfer assembly which drives the misaligned end portion of the blade 12 is manipulated to produce the urging motion of one of the pivot arms 18,19 toward the first surface 12. An important feature of the invention is that when one pivot arm 18,19 and its respective motion transfer assembly (comprising rod-like member 40,42) driving the pivot arm 18 is active, the other pivot arm and its respective. motion transfer system is stationary. This is to ensure minimum lapsed time in achieving precise alignment of the blade 12 with the roller surface 14.

Parts List

- 10 . . . apparatus or pivot arm
- 12 . . . first surface or doctor blade
- 14 . . . second surface or print roller surface
- 16 . . . frame
- 18, 19 . . . pivot arms
- 20 . . . pivot pin
- 22 . . . lateral edge of doctor blade
- 24 . . . nut plate
- 26, 28 . . . opposing end portions of blade
- 30 . . . rear side of blade
- 32 . . . contact roller
- 34 . . . end edge of contact roller
- 36,38 . . . motion transfer assemblies
- 40,42 . . . rod-like members.
- 44,46 . . . one end of rod-like members
- 48 . . . connecting pin
- 50,52 . . . opposite ends of rod-like member
- 54 . . . threaded portion of rod-like members
- 56 . . . nut element
- 58 . . . plate members While the invention has been shown and described with reference to particular embodiments thereof, those skilled in the art will understand that other variations in form and detail may be made without departing from the scope and spirit of the invention.

I claim:

1. Apparatus for adjusting and aligning either of a first and second lateral end edge of a first, slidable surface into proximate contact with a second, rotating surface, comprising:

a frame for supporting the first surface for translational movement;

means communicating with said frame for urging one of said first and second lateral end edges of the first surface towards and into contact with a second surface, said urging means having at least one rod member pivotably mounted to said frame for imparting pivotable movement of either of said first and second lateral edges of said first surface about said other lateral end edge thereby urging said first surface into alignable uniform contact with said second surface; and, means for activating said at least one rod member for movement into urging contact with said one lateral end edge of said first surface so that said first surface moves pivotably about said other lateral end edge to align with said second surface, said means for activating comprising a connecting link pivotably connected at one end to said at least one rod member and mounted for axial movement in said frame at an opposite end by a hex nut and threaded screw assembly such that axial movement of said connecting link causes corresponding movement of said at least one rod member towards and into urging contact with said one lateral end edge of said first surface thereby causing said first surface to move pivotably about said other lateral end edge towards and into alignable contact with said second surface.

2. The apparatus recited in claim 1 wherein said at least one rod member includes a contact roller mounted for rotational contact with the first surface, said contact roller being arranged in an end edge of the rod member.

3. The apparatus recited in claim 1, wherein said at least one rod member is fixed to the frame for supporting the urging means.

4. The apparatus recited in claim 1 wherein said second surface is a roller having an exposed compliant surface.

5. The apparatus recited in claim 1 wherein said first surface is substantially flat and has a rear edge for accommodating resting and active contact by said urging means, and a front edge configured to contact the second surface.

* * * * *

UNITED STATES PATENT AND TRADEMARK OFFICE

CERTIFICATE OF CORRECTION

PATENT NO. : 5,761,997
DATED : June 9, 1997
INVENTOR(S) : Jean Xydias

It is certified that error appears in the above-identified patent and that said Letters Patent is hereby corrected as shown below:

On the title page, insert the following:

--Related U.S. Application Data
[60] Provisional application No. 60/007,129 October 31, 1995--.

Column 1, line 2, insert the following:

--CROSS REFERENCE TO RELATED APPLICATION
Reference is made to and priority claimed from U.S. Provisional application Ser. No. US 60/007,129, filed Oct. 31, 1995, entitled APPARATUS AND METHOD FOR ALIGNING SURFACES.

Signed and Sealed this

Sixteenth Day of February, 1999

*Attest:*

*Attesting Officer*

*Acting Commissioner of Patents and Trademarks*